US010959470B2

(12) United States Patent
Richwine

(10) Patent No.: US 10,959,470 B2
(45) Date of Patent: Mar. 30, 2021

(54) MAGNETIC HAIR EXTENSIONS

(71) Applicant: Anna Rose Richwine, Palmdale, CA (US)

(72) Inventor: Anna Rose Richwine, Palmdale, CA (US)

( * ) Notice: Subject to any disclaimer, the term of this patent is extended or adjusted under 35 U.S.C. 154(b) by 121 days.

(21) Appl. No.: 16/005,449

(22) Filed: Jun. 11, 2018

(65) Prior Publication Data

US 2019/0373973 A1 Dec. 12, 2019

(51) Int. Cl.
*A41G 5/00* (2006.01)

(52) U.S. Cl.
CPC ..... *A41G 5/0053* (2013.01)

(58) Field of Classification Search
USPC ..... 132/201
See application file for complete search history.

(56) References Cited

U.S. PATENT DOCUMENTS 3,525,346 A * 8/1970 Reeves ..... A41G 3/0075 132/201
3,662,766 A * 5/1972 Maassen ..... A41G 5/0026 132/201
5,725,928 A 3/1998 Kenney et al.
5,741,336 A * 4/1998 Fraser ..... A41G 3/0033 132/53
7,971,277 B2 7/2011 Romiti
2005/0278903 A1 12/2005 Dunaye
2006/0162734 A1* 7/2006 Kagami ..... A41G 3/00 132/53
2009/0217939 A1* 9/2009 Rabe ..... A41G 5/02 132/218
2015/0327611 A1* 11/2015 Kleinman ..... A41G 5/0046 132/201
2016/0206031 A1* 7/2016 Stoka ..... A41G 5/02
2017/0164674 A1 6/2017 Rubenstein
(Continued)

FOREIGN PATENT DOCUMENTS

JP 5075289 B1 11/2012
WO 2012010814 A1 1/2012
WO 2018094481 A1 5/2018

OTHER PUBLICATIONS

Lux Beauty Club Natural Wave Auburn 33 Magnet Hair, accessed Jul. 19, 2018 at https://luxbeautyclub.com/collections/magnet-hair/products/wavy-auburn-33-magnet-hair.
(Continued)

*Primary Examiner* — Jacqueline T Johanas
*Assistant Examiner* — Jennifer Gill
(74) *Attorney, Agent, or Firm* — Perkins Coie LLP

(57) ABSTRACT

A magnetic hair extension apparatus is disclosed. The apparatus can use a magnet, which enables the apparatus to be conveniently applied and removed from the hair of a user. The apparatus includes a first portion having a magnet and a hair weft, and a second portion having magnetic material and a hair weft. To wear, the second portion is placed over the first portion with the hair of the user sandwiched between the first portion and the second portion. The magnet is attracted to the magnetic material and thus, can securely attach the apparatus to the hair of the user. A combination of these materials results in an easy to use, easy to remove, easy to transport, and harmless hair extension apparatus.

21 Claims, 6 Drawing Sheets

(56) References Cited

U.S. PATENT DOCUMENTS

| | | | | |
|---|---|---|---|---|
| 2017/0202290 | A1* | 7/2017 | Thomas | A41G 5/006 |
| 2017/0234340 | A1* | 8/2017 | Pensak | A41F 1/002 24/3.1 |
| 2018/0070664 | A1* | 3/2018 | Hazan | A41G 5/0073 |
| 2019/0090567 | A1* | 3/2019 | Johnson | A41G 5/0073 |
| 2019/0166938 | A1* | 6/2019 | Bendavid | A41G 5/0073 |
| 2019/0216152 | A1* | 7/2019 | Francis | A41G 5/0073 |
| 2019/0254372 | A1* | 8/2019 | Rigby | A41G 5/0073 |
| 2019/0261715 | A1* | 8/2019 | Hunter | A61Q 1/10 |
| 2019/0281912 | A1* | 9/2019 | Mayer | A41G 5/0053 |

OTHER PUBLICATIONS

"Magnet Hair Human Extensions" uploaded by Lux Beauty Club, Apr. 18, 2018 [retrieved Aug. 6, 2019] Retrieved from the Internet: <URL: www.youtube.com/watch?v=I7T59H9a0J4.

International Search Report/Written Opinion dated Aug. 29, 2019 of PCT/US2019/036359 (10 pages).

* cited by examiner

MAGNETIC HAIR EXTENSIONS

TECHNICAL FIELD

This disclosure relates generally to a hair extension apparatus which can be worn by a user. More particularly, but not exclusively, to a hair extension apparatus using a magnet.

BACKGROUND

Hair styles are one of the more noticeable features of people. Due to this, people generally style, color, and cut hair to improve their appearance and even self-esteem. Others, due to age, genetics or preference choose to use hair extensions to provide a temporary and non-committal method to change their hair style. Hair extensions can be used to add different hair colors, lengths, and even form (e.g., curls, waves, straight) into the natural hair of a user. Common methods of incorporating hair extensions are by weaves, by the strand-by-strand method, and by the clip-in-hair method.

A traditional weave hair extension is expensive and lasts for a short period. Further, the application process for the traditional weave can take several hours. In the strand-by-strand method, the extensions are glued to small pieces of natural hair of the user by a trained and licensed hair stylist. The strand-by-strand application process can harm the hands of the stylist and the hair of the user, while also costing significantly high.

SUMMARY

Introduced here is a hair extension apparatus that utilizes magnetic fields to attach a hair extension apparatus to the hair of the user. The apparatus can use a magnet, which enables the apparatus to be conveniently applied and removed from the hair of the user. The apparatus includes a magnet, magnetic material, a hair weft, and a polymer base. The magnet is attracted to the magnetic material and thus, can securely attach the apparatus to the hair of the user.

In some embodiments, the apparatus has two separate portions. The first portion comprises a magnet, a hair weft, and a polymer base. The second portion comprises a magnetic material such as iron oxide, a hair weft, and a polymer base. In other embodiments, the apparatus is one piece with two portions or ends. The first portion comprises a magnet, a hair weft, and a polymer base, and the second portion, which is foldably coupled with the first portion, comprises a magnetic material, a hair weft, and a polymer base.

BRIEF DESCRIPTION OF THE DRAWINGS

One or more embodiments of the present disclosure are illustrated by way of example and not limitation in the figures of the accompanying drawings, in which like references indicate similar elements.

DETAILED DESCRIPTION

Figure 4:
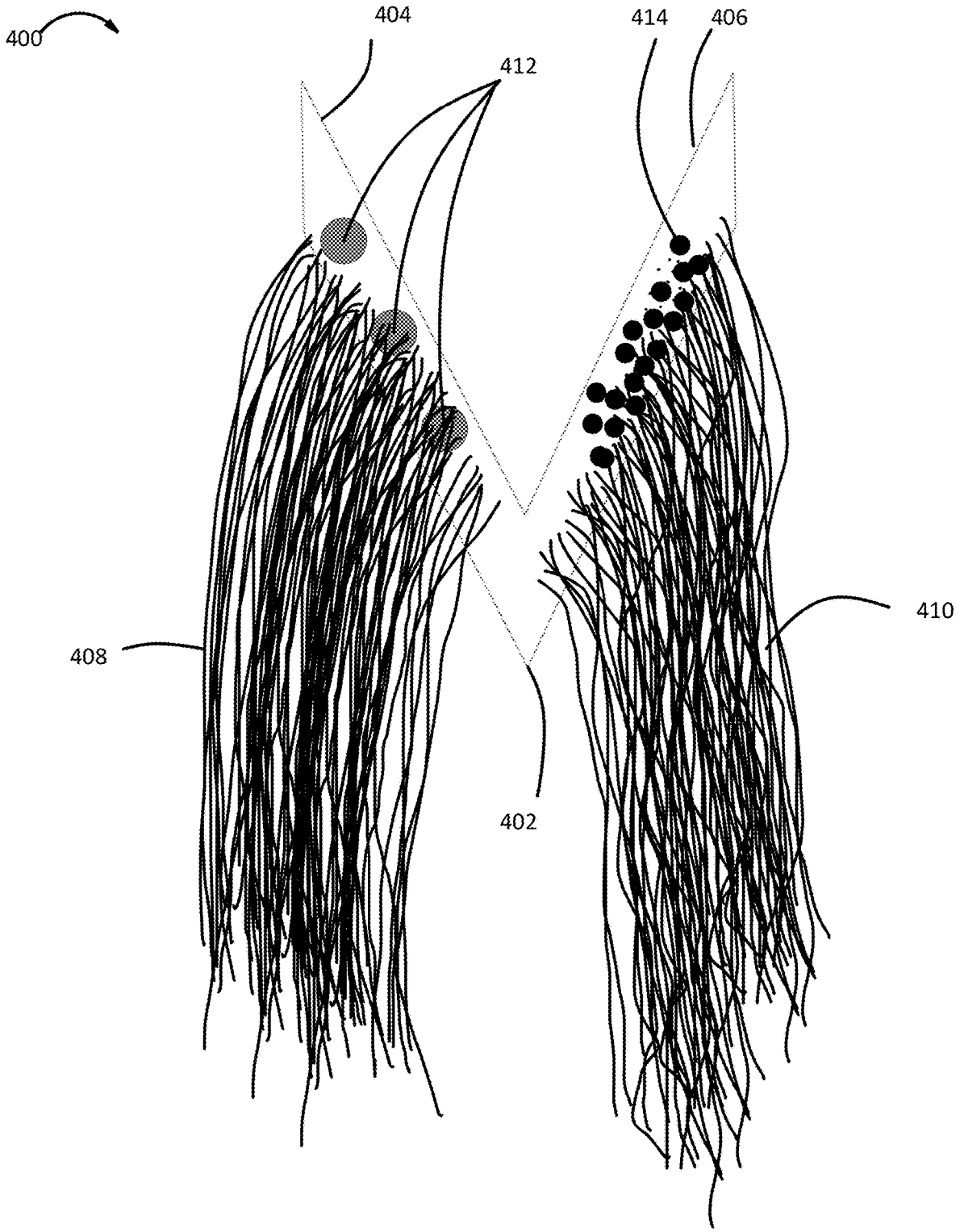
FIG. 4 illustrates a second configuration of a hair apparatus.

The hair extension apparatus can provide an easy to apply, easy to remove, and harmless method of using hair extensions. The hair extension apparatus disclosed herein can include a first portion with a magnet, a second portion with a magnetic material, a hair weft, and a polymer base. The first portion is attracted to the second portion due to the attraction between the magnet and the magnetic material. Thus, the first portion and the second portion securely attach to each other and the hair of the user. The second portion can include materials that act as a shield to diminish the magnetic field caused by the first portion. By doing so, the magnetic field of the apparatus may not attract peripheral metallic objects. In some embodiments, the two portions are implemented as separate and distinct portions, e.g., as shown in FIG. 1, and in some embodiments, the apparatus is implemented as a single piece in which the two portions are foldably coupled to each other, e.g., as shown in FIG. 4.

Figure 1:
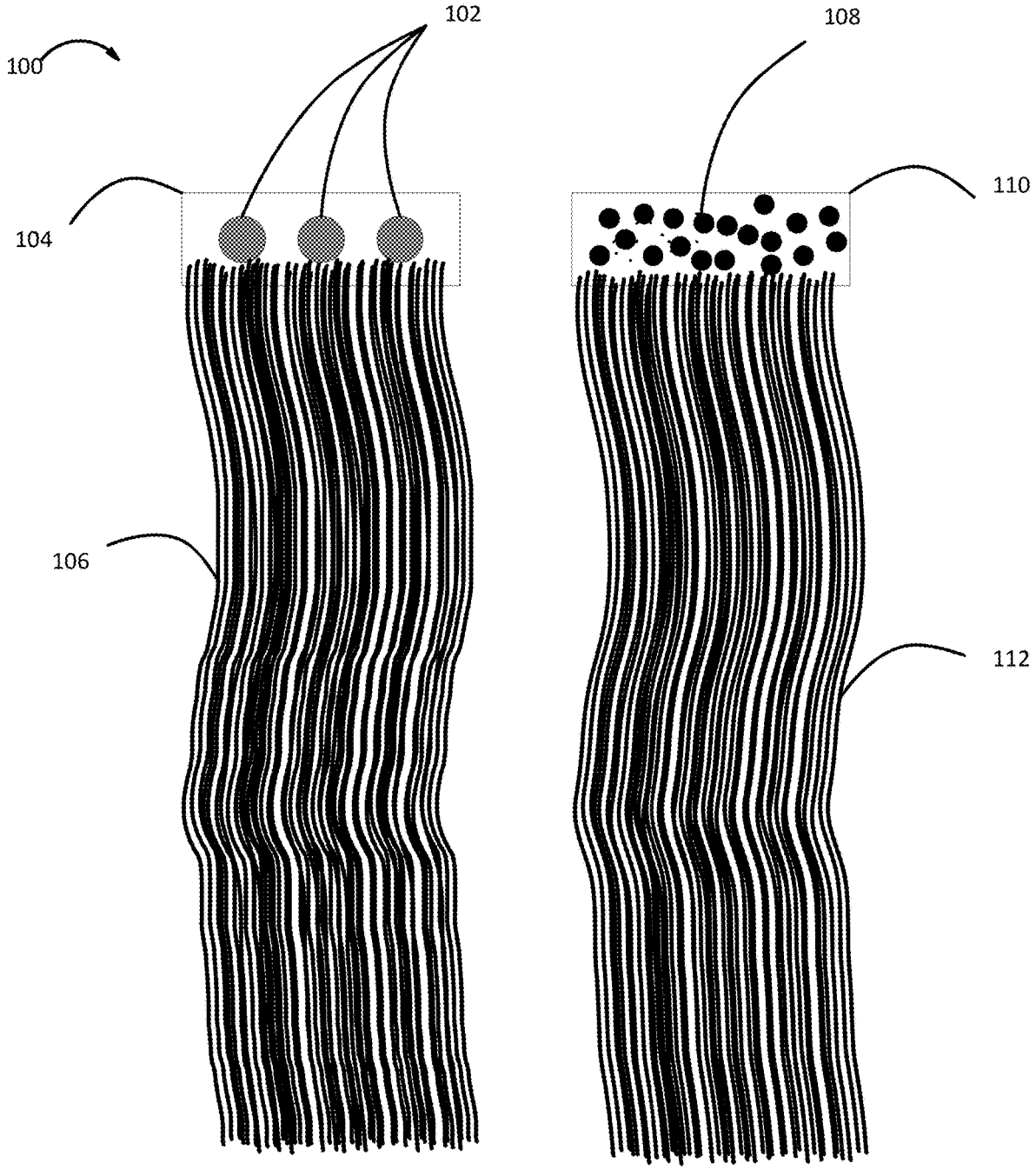
FIG. 1 illustrates a first configuration of a hair extension apparatus.

FIG. 1 illustrates a first configuration of a hair extension apparatus. The hair extension apparatus 100 includes two separate and distinct portions 104 and 110. Inner portion 104 can be made of a polymer such as polyurethane, oil based materials, or wax based materials. In some embodiments, inner portion 104 can be made with other materials, which can be coated with a polymer, or a polymer tape. For example, inner portion 104 can have a cardboard base which is coated with polyurethane.

Inner portion 104 can be in various shapes and/or sizes to help conceal or place the apparatus 100 in the hair of a user. Inner portion 104 can also be shaped differently based on the preference of a user. For example, a user may only want a small hair extension. Thus, a small dot-like shape may be best. In other situations, a user may want to maximize the use of a hair extension. Thus, a large square or rectangle may be best. An example dimension of inner portion 104 can be a rectangle of 4 cm by 1 cm.

Additionally, inner portion 104 can be in various colors. This helps the apparatus 100 blend in with the hair of the user. For example, a user with black hair may not want to use the inner portion 104 that is of a color other than black as the inner portion 104 may appear to be distinct from the hair, which may not be a pleasing sight. Therefore, inner portion 104 can incorporate a dye for a particular color during manufacture.

Inner portion 104 includes magnet 102. Magnet 102 can be in the form of one or more pieces, one or more shapes, and can be of one or more types. In some embodiments, magnet 102 is a permanent earth magnet such as a neodymium rare earth magnet. In other embodiments, magnet 102 is a combination of neodymium rare earth magnets and samarium-cobalt magnets.

Magnet 102 is mechanically coupled to inner portion 104. Magnet 102 is incorporated to inner portion 104 by various methods such as by adhesive or incorporated therein during manufacture. In some embodiments, inner portion 104 can act as a sleeve to receive magnet 102. In other embodiments, magnet 102 can be incorporated inside a polyurethane material of inner portion 104 during manufacture. Thus, magnet 102 can be encapsulated inside the polyurethane material of inner portion 104. In other embodiments, magnet 102 can be bonded (e.g., by adhesive) to inner portion 104.

Magnet 102 can be placed anywhere on inner portion 104 to maximize attraction to the magnetic material incorporated in outer portion 110. For example, magnet 102 can be placed in the middle, near the outer edges, or in any other placement pattern. In addition, magnet 102 can be any size or shape that fits within the dimensions of inner portion 104. For example, magnet 102 can be a 0.5-inch by 1-inch rectangle, a 0.5-inch by 0.5-inch square, or a circle with a 0.5-inch diameter.

Inner portion 104 includes hair weft 106. Hair weft 106 can be Remy hair, non-Remy hair, human hair, synthetic hair, or a combination thereof. Hair weft 106 can be attached to inner surface 104 by, for example, weaving, heat and bond, or adhesive. Additionally, hair weft 106 can be placed anywhere near any side of inner portion 104. For example, hair weft 106 can be placed to only cover 25% of inner portion 104 or to cover a 100% of inner portion 104. In another example, hair weft 106 can be placed near one or both sides of inner portion 104. Regardless, the placement of the hair weft 106 is such that the hair weft 106 does not diminish the magnetic attraction between the inner portion 104 and the outer portion 110 to an extent that keeps the apparatus 100 from being secured to the hair of the user.

Outer portion 110 can be made of a polymer such as polyurethane, oil based materials, or wax based materials. Outer portion 110 can also be made of other materials, which can be coated with a polymer, or covered using a polymer tape. For example, outer portion 110 can have a cardboard base which is coated with polyurethane. Additionally, similar to inner portion 104, the polymer can be in various colors and various shapes to blend in with the hair of the user or align with the preference of the user. An example dimension of outer portion 110 can be a rectangle of 4 cm by 1 cm.

Magnetic material 108 is mechanically coupled to outer portion 110. Magnetic material 108 can be in the form of a powder (as shown) or solid piece(s). In some embodiments, magnetic material 108 is made of a ferromagnetic magnetic material such as black iron oxide. Magnetic material 108 is incorporated to outer portion 110 by various methods such as by adhesive or by incorporation during manufacture. In some embodiments, outer portion 110 can act as a sleeve to receive magnetic material 108. In other embodiments, magnetic material 108 can be incorporated inside a polyurethane material of outer portion 110 during manufacture. Thus, magnetic material 108 can be encapsulated inside the polyurethane material of outer portion 110. In other embodiments, magnetic material 108 can be bonded (e.g., by adhesive) to outer surface 110. In yet another embodiment, magnetic material 108 can be in the form of a powder which can be incorporated into outer surface 110 during manufacture. For example, black iron oxide powder can be mixed into polyurethane during manufacture. This mixture is then molded to become outer surface 110. In some embodiments, the magnetic material 108 can also be a magnet.

Outer portion 110 includes hair weft 112. Hair weft 112 is mechanically coupled to outer portion 110. Hair weft 112 can be mechanically coupled to outer surface 110 by, for example, weaving, heat and bond, or adhesive. Additionally, hair weft 112 can be placed anywhere near any side of the outer portion 110. For example, hair weft 112 can be placed to cover 25% of the outer portion 110 or to cover a 100% of the outer portion 110. In another example, hair weft 106 is placed near one or both sides of outer portion 110.

Figure 2A:
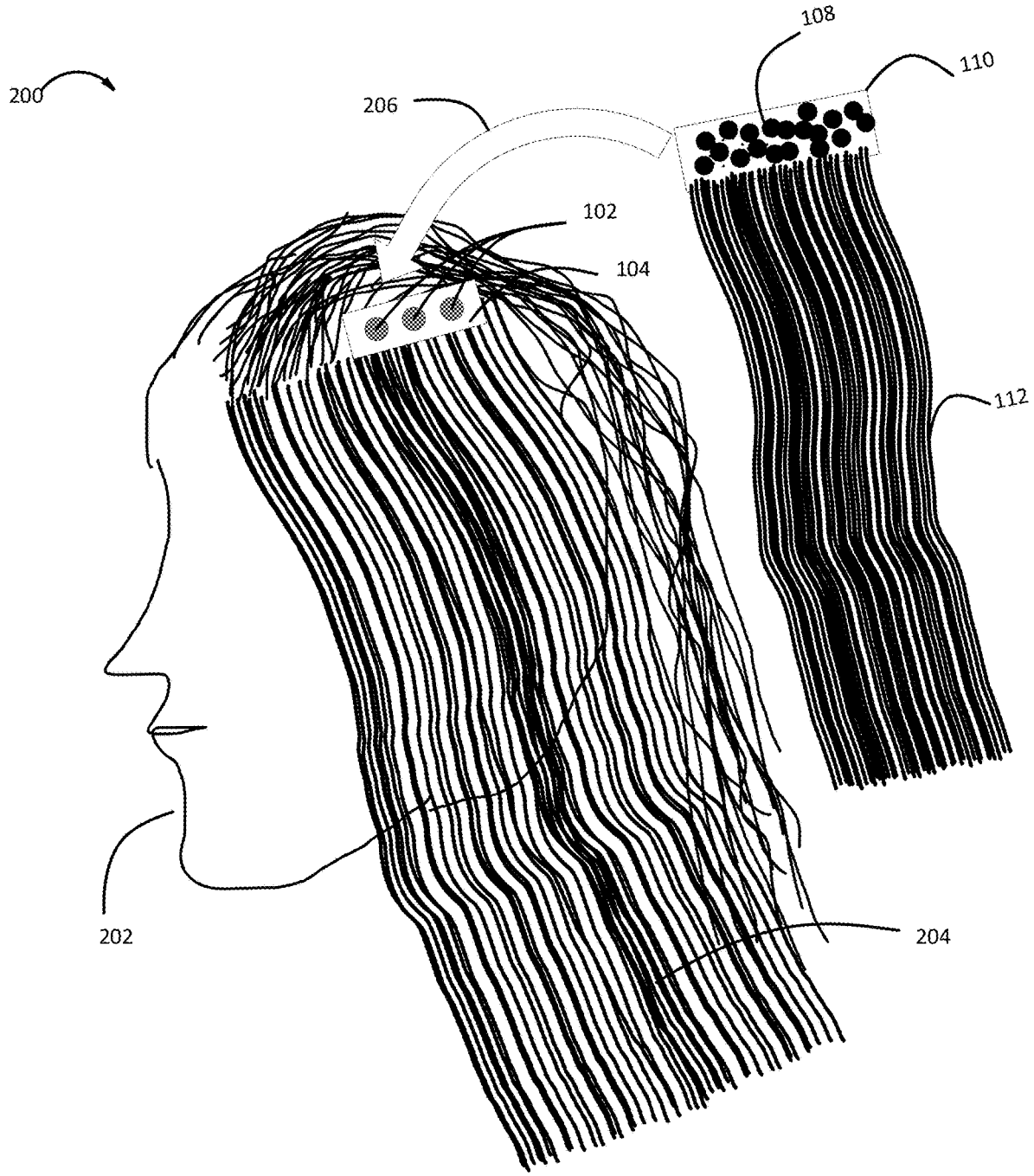
FIG. 2A illustrates a method of applying the apparatus to a user.

FIG. 2A illustrates an example of a method of applying hair extension apparatus 100 to hair of a user 202. In this embodiment, a spot on the head of the user is selected for placement of the apparatus 100, a portion of the hair of the user 202 near the selected spot is brushed out of the way, inner portion 104 is held against the scalp or hair of user 202. Once in place, a portion of the hair of user 202 can cover inner portion 104. Next, outer portion 110 can be placed over the inner portion 104 (as depicted by arrow 206) to magnetically couple with inner portion 104 with the portion of the hair covering inner portion 104 being sandwiched between inner portion 104 and outer portion 110. Once coupled, hair 204 of user 202, including the brushed out of the way hair, can cover outer portion 110 (and also inner portion 104) of hair extension apparatus 100.

The two portions 104 and 110 can be placed anywhere on hair 204 of user 202. In some embodiments, apparatus 100 can be placed on the scalp of user 202. In other embodiments, apparatus 100 can be placed in hair 204 near neck of user 202, near the bottom of hair 204, or away from the scalp of user 202. For example, to thicken the appearance of hair 204, user 202 can place apparatus 100 near the scalp of user 202. Similarly, to make hair 204 of user 202 appear longer, user 202 can attach apparatus 100 away from the scalp of user 202.

The two portions 104 and 110 can be placed anywhere on the scalp or hair of user 202 and at any angle. In some embodiments, apparatus 100 can be placed on the side, back, front or top of the head of user 202. Although the slant of the scalp of the user 202 may change, it will not affect the ability of the apparatus 100 to stay in place. This is because portions 104 and 110 do not adhere to the scalp of the user 202. Portions 104 and 110 adhere to each other and hair 204 of user 202. In other embodiments, the portions 104 and 110 can be placed at any angle. For example, the apparatus 100 can be placed horizontally or vertically, in reference to the directionality of hair 204 of user 202. While the example of FIG. 1 shows a first arrangement of apparatus 100 in which inner portion 104 is placed toward/near the scalp (and hence referred to as "inner portion") and outer portion 110 is placed over inner portion 104 and away from the scalp (and hence referred to as "outer portion"), other arrangements of apparatus 100 are also possible. For example, in a second arrangement, outer portion 110 is placed toward/near the scalp and inner portion 104 is placed over outer portion 110 (and away from the scalp). However, in some embodiments, the second arrangement may be disadvantageous as the magnet 102 in the inner portion 104, which is away from the scalp, can attract any peripheral metallic materials, e.g., curling iron, that the user 202 may use for the hair 204.

Figure 2B:
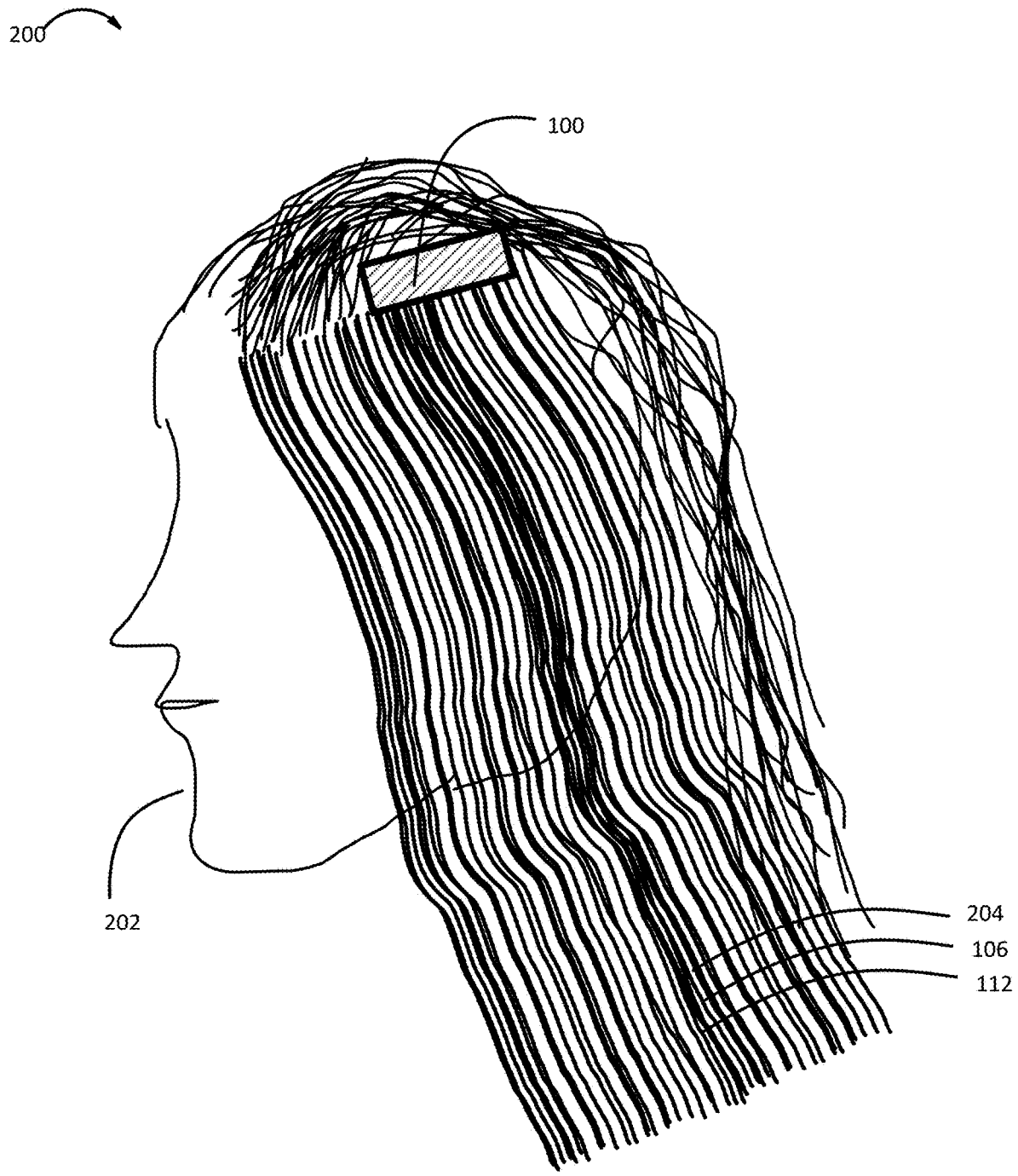
FIG. 2B illustrates the apparatus after being worn by the user.

FIG. 2B illustrates apparatus 100 after being worn by user 202. Outer portion 110 has been placed on top of inner portion 104 to magnetically couple to each other. The two portions 104 and 110 are separated by at least a portion of hair 204 of user 202. This allows for apparatus 100 to stay in place while user 202 continues daily activities. The appearance of hair 204 of user 202 is a combination of hair 204 of user 202, hair weft 106 and hair weft 112. In some embodiments, hair 204 of user 202 can cover apparatus 100. By doing so, the apparatus may not be visible.

Outer portion 110 can shield the magnetic field of magnet 102. This is beneficial because apparatus 100 may be less attracted to the peripheral metallic materials in the proximity of apparatus 100. In some embodiments, outer portion 110 covers up inner portion 104. By doing so, the magnetic field of magnet 102 may be diminished or may have a smaller range that keeps apparatus 100 from being attracted to the peripheral metallic materials.

In other embodiments, outer portion 110 may include non-magnetic materials to better prevent attraction to peripheral metallic materials. For example, one side of the outer portion 110 may have the magnetic material (e.g., the side attracted to inner portion 104), while the other side (e.g., the side facing outwards from the user 202) may be made of a non-magnetic material such as plastic.

Figure 3:
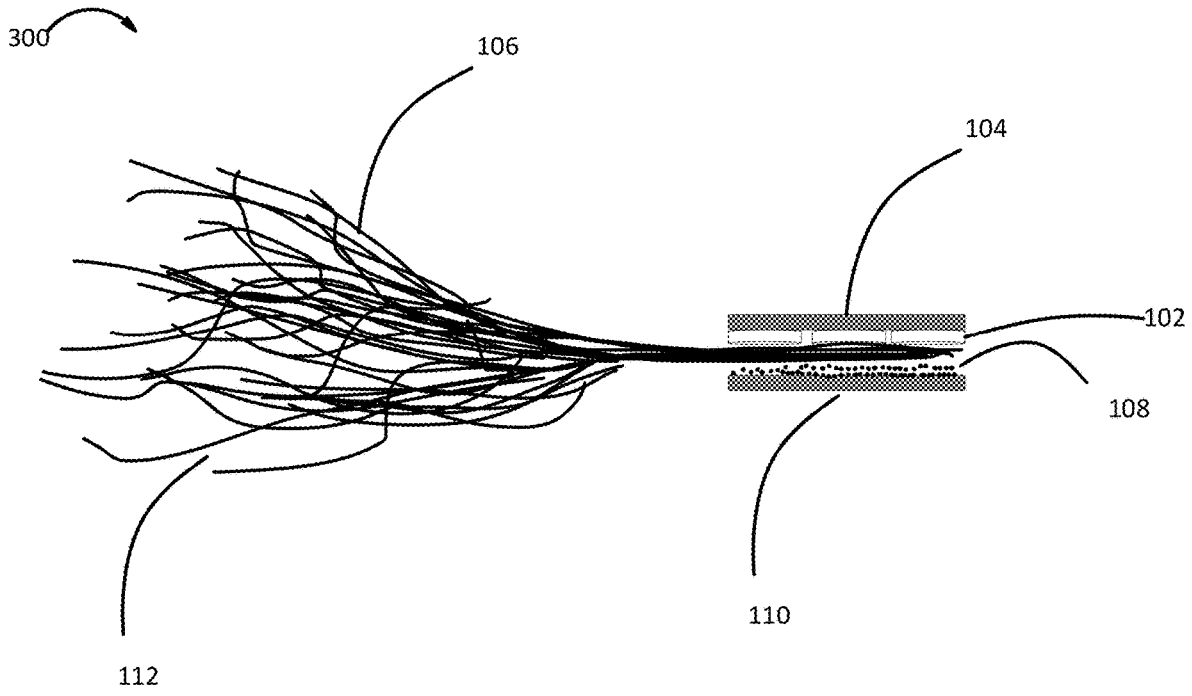
FIG. 3 shows the apparatus with two portions magnetically coupled to each other.

FIG. 3 shows another perspective of apparatus 100 with two portions 104 and 110 magnetically coupled to each other. In this embodiment, magnetic material 108 is in powder form and is incorporated into outer portion 110. Inner portion 104 has three magnets 102. Hair wefts 106 and 112 can be Remy hair, non-Remy hair, human hair, synthetic hair, or a combination thereof.

FIG. 4 illustrates a second configuration of a hair apparatus. Hair apparatus 400 includes a left portion 404 and a right portion 406 which are foldably coupled to each other at middle portion 402. Apparatus 400 has hair weft 408, hair weft 410, magnet 412, magnetic material 414, a left portion 404, a right portion 406, and middle portion 402. In some embodiments, the left portion 404 is similar to inner portion 104 of apparatus 100, right portion 406 to outer portion 110, hair weft 408 to hair weft 106, hair weft 410 to hair weft 112, magnet 412 to magnet 102, and magnetic material 414 to magnetic material 108.

Middle portion 402 can be means or a mechanism that allows the left portion 404 and the right portion 406 to be folded towards and away from each other. In some embodiments, the middle portion 402 can be a mechanical element that connects two objects, such as a hinge, a coiled spring, or a clasp. In some embodiments, the left portion 404, middle portion 402, and the right portion 406 are part of the same piece (and made of the same material such as polyurethane), and middle portion 402 can be a perforated fold line that facilitates the folding of the left portion 404 and the right portion 406 towards or away from each other. In some embodiments, middle portion 402 can be made of similar material as the left portion 404 and the right portion 406. For example, all three portions 404, 402, and 406 can be made of polyurethane in which middle portion 402 forms a perforated fold line separating the left and right portions. Left portion 404 can be in the form of a sleeve to receive a neodymium rare earth magnet, and right portion 406 can have black iron oxide powder incorporated into polyurethane during manufacture.

Middle portion 402 can physically couple both the left portion 404 and the right portion 406. User 202 can wear apparatus 400 in a way similar to apparatus 100. User 202 can hold the left portion 404 near the selected spot, cover the left portion 404 with a portion of the hair 204 of the user 202, then fold the right portion 406 onto the left portion 404 to adhere the apparatus 400 to hair 204 of user 202. To remove apparatus 400, user 202 can pull one portion (e.g., left portion 404 or right portion 406) away from the other portion (e.g., left portion 404 or right portion 406).

Figure 5:
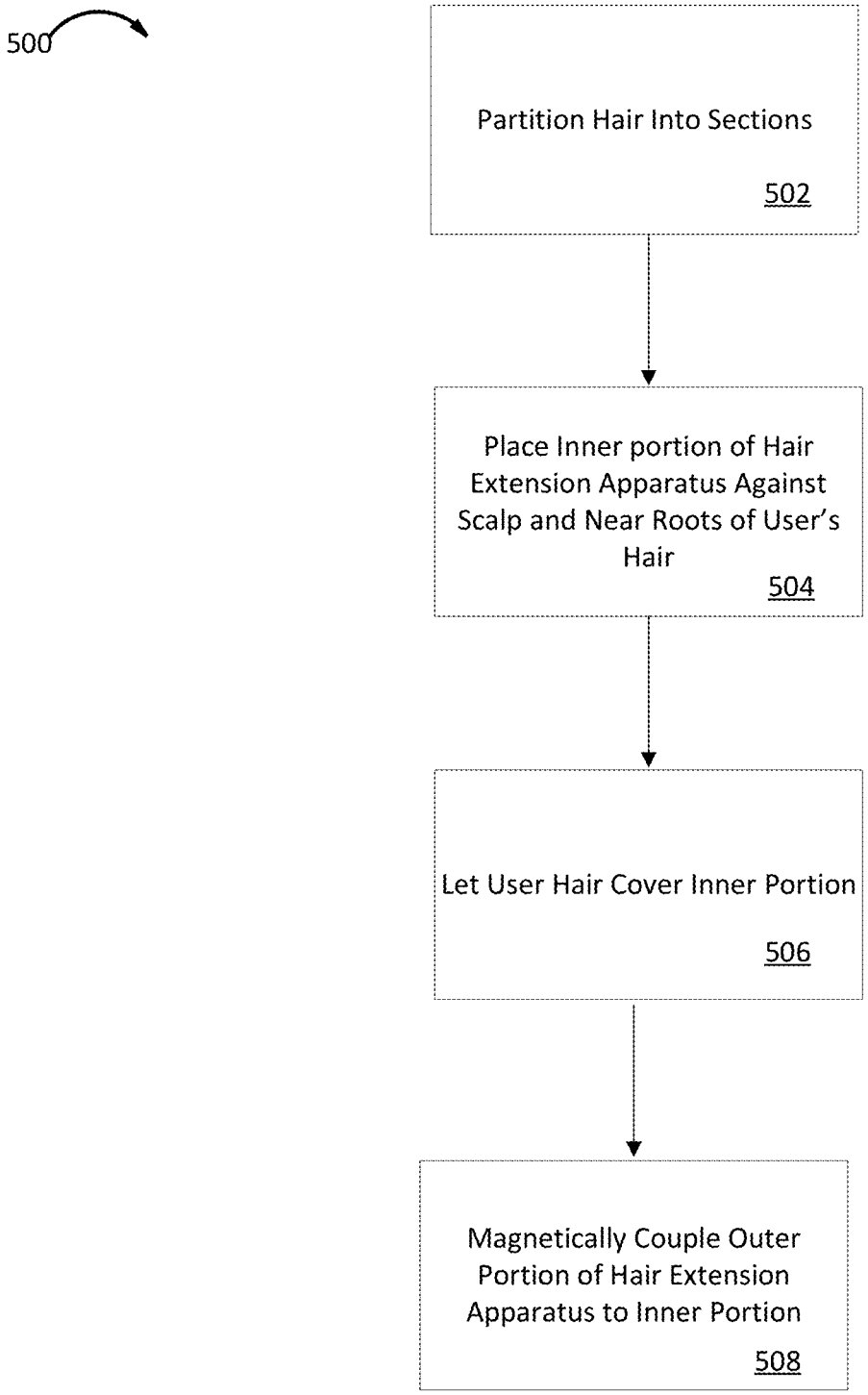
FIG. 5 is a flowchart of a process of applying the hair extension apparatus.

FIG. 5 is a flowchart of a process of applying hair extension apparatus 100. In step 502, user 202 separates hair 204 to make space for apparatus 100. For example, if user 202 wishes to use apparatus 100 at the back of the head of user 202, then space must be made for apparatus 100 at the back of the head user 202. This can be done by physically moving hair 204 to a different location such as by a hair clip or rubber band. User 202 can also lift hair 204 then release the hair 204 after apparatus 100 has been placed.

In step 504, inner portion 104 is placed against the scalp of user 202. In other embodiments, user 202 can place inner portion 104 anywhere along hair 204 of user 202.

In step 506, inner portion 104 is covered with a portion of hair 202.

In step 508, outer portion 110 is magnetically coupled to inner portion 104.

In other embodiments, user 202 can alter these steps in order to best achieve the preference of user 202. For example, user 202 may place outer portion 110 against the scalp of user 202 and inner portion 104 on top of the outer portion 110. This can be done if user 202 wants to magnetically couple other decorative accessories to the head of user 202.

In this description, references to "user" mean the person who wears the hair extension apparatus or the person who has the apparatus placed on their person.

In this description, references to "an embodiment", "one embodiment" or the like, mean that the particular feature, function, structure or characteristics being described is included in at least one embodiment of the technique introduced here. Occurrences of such phrases in this specification do not necessarily all refer to the same embodiment. On the other hand, the embodiments referred to also are not necessarily mutually exclusive.

Any or all of the features and functions described above can be combined with each other, except to the extent it may be otherwise stated above or to the extent that any such embodiments may be incompatible by virtue of their function or structure, as will be apparent to persons of ordinary skill in the art. Unless contrary to physical possibility, it is envisioned that (i) the methods/steps described herein may be performed in any sequence and/or in any combination, and that (ii) the components of respective embodiments may be combined in any manner.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A hair extension apparatus, consisting essentially of:

an inner portion comprising:

a first cardboard base coated in a first polyurethane covering, an upper end of a first hair weft bonded to the first cardboard base, and a first magnetic material bonded to the first cardboard base, the first magnetic material comprising neodymium rare earth magnets;

an outer portion comprising:

a second cardboard base coated in a second polyurethane covering, an upper end of a second hair weft bonded to the second cardboard base, and a second magnetic material bonded to the second cardboard base, the second magnetic material comprising black iron oxide powder;

wherein the inner portion is configured to be disposed below a section of a user's natural hair and the outer portion is configured to be positioned above the section of the user's natural hair; and wherein magnetic attraction between the first magnetic material and the second magnetic material is sufficient to hold the inner portion and the outer portion on the section of the user's natural hair.

2. The apparatus of claim 1, wherein the first hair weft and the second hair weft include Remy hair.

3. The apparatus of claim 1, wherein the first hair weft and the second hair weft include non-Remy hair.

4. The apparatus of claim 1, wherein the first hair weft and the second hair weft include human hair.

5. The apparatus of claim 1, wherein the inner portion and the outer portion are foldably connected.

6. The apparatus of claim 1, wherein the inner portion and the outer portion are dot shaped.

7. The apparatus of claim 1, wherein the inner portion and the outer portion are square shaped.

8. The apparatus of claim 1, wherein the inner portion and the outer portion are rectangle shaped.

9. The apparatus of claim 1, wherein the first magnetic material further comprises a samarium-cobalt magnet.

10. The apparatus of claim 1, wherein the first hair weft covers twenty-five percent of the inner portion.

11. The apparatus of claim 1, wherein the first hair weft and the second hair weft are bonded to the first cardboard base and the second cardboard base by an adhesive.

12. A hair extension apparatus, consisting essentially of:

an inner portion, comprising:

a first cardboard base coated in a first polyurethane covering, an upper end of a first hair weft bonded to the first cardboard base, and a first magnetic material bonded to the first cardboard base, the first magnetic material comprising neodymium rare earth magnets;

an outer portion comprising:

a second cardboard base coated in a second polyurethane covering, an upper end of a second hair weft bonded to the second cardboard base, a second magnetic material bonded to the second cardboard base, the second magnetic material comprising black iron oxide powder;

wherein the inner portion is configured to be disposed below a section of a user's natural hair and the outer portion is configured to be positioned above the section of the user's natural hair, wherein magnetic attraction between the first magnetic material and the second magnetic material is sufficient to hold the inner portion and the outer portion on the section of the user's natural hair wherein the inner portion and the outer portion are foldably connected by a living hinge.

13. The apparatus of claim 12, wherein the first hair weft and the second hair weft include Remy hair.

14. The apparatus of claim 12, wherein the first hair weft and the second hair weft include non-Remy hair.

15. The apparatus of claim 12, wherein the first hair weft and the second hair weft include human hair.

16. The apparatus of claim 12, wherein the inner portion and the outer portion are dot shaped.

17. The apparatus of claim 12, wherein the inner portion and the outer portion are square shaped.

18. The apparatus of claim 12, wherein the inner portion and the outer portion are rectangle shaped.

19. The apparatus of claim 12, wherein the first magnetic material further comprises a samarium-cobalt magnet.

20. The apparatus of claim 12, wherein the first hair weft covers twenty-five percent of the inner portion.

21. The apparatus of claim 12, wherein the first hair weft and the second hair weft are bonded to the first cardboard base and the second cardboard base by an adhesive.

* * * * *